United States Patent [19]

Böhme

[11] 4,277,858

[45] Jul. 14, 1981

[54] PIECE OF FURNITURE FOR SITTING AND LYING

[76] Inventor: Gunther Böhme, Dachswaldweg 55, D-7000 Stuttgart, Fed. Rep. of Germany

[21] Appl. No.: 93,971

[22] Filed: Nov. 14, 1979

[30] Foreign Application Priority Data

Nov. 14, 1978 [DE] Fed. Rep. of Germany ..... 2849304
Sep. 22, 1979 [DE] Fed. Rep. of Germany ... 7926923[U]
Oct. 5, 1979 [DE] Fed. Rep. of Germany ..... 2940364

[51] Int. Cl.[3] ..... A61G 7/06; A41C 19/00

[52] U.S. Cl. ..... 5/66; 5/68; 5/191

[58] Field of Search ..... 5/66–69, 5/164 R, 191

[56] References Cited

U.S. PATENT DOCUMENTS

| | | | |
|---|---|---|---|
| 3,353,193 | 11/1967 | Greiner | 5/69 |
| 3,877,088 | 4/1975 | Bouman | 5/66 |
| 3,974,530 | 8/1976 | Lusch et al. | 5/68 |
| 4,100,630 | 7/1978 | Klose et al. | 5/66 |

*Primary Examiner*—Casmir A. Nunberg
*Attorney, Agent, or Firm*—Shlesinger, Arkwright, Garvey & Dinsmore

[57] ABSTRACT

A piece of furniture for sitting and lying, more particularly a sickbed, having a horizontal surface divided into head, central and foot portions. A stationary frame extends at least the length of the central portion and the head and foot portions are pivotally mounted on the stationary frame about horizontal axes so they may be adjusted to horizontal and inclined positions by shifting the weight of the user's body and can be fixedly positioned by locking devices. A spring device, such as a torsion spring, equalizes the weight of the user on the head portion and the spring device is adjustable to control the initial stress applied to the head portion. The central portion is pivotally connected to the head portion through a connection that allows for end play and provides for leverage so that as the head portion is shifted to an inclined position, the central portion automatically moves to a proper reverse sloping position to accommodate sitting.

21 Claims, 7 Drawing Figures

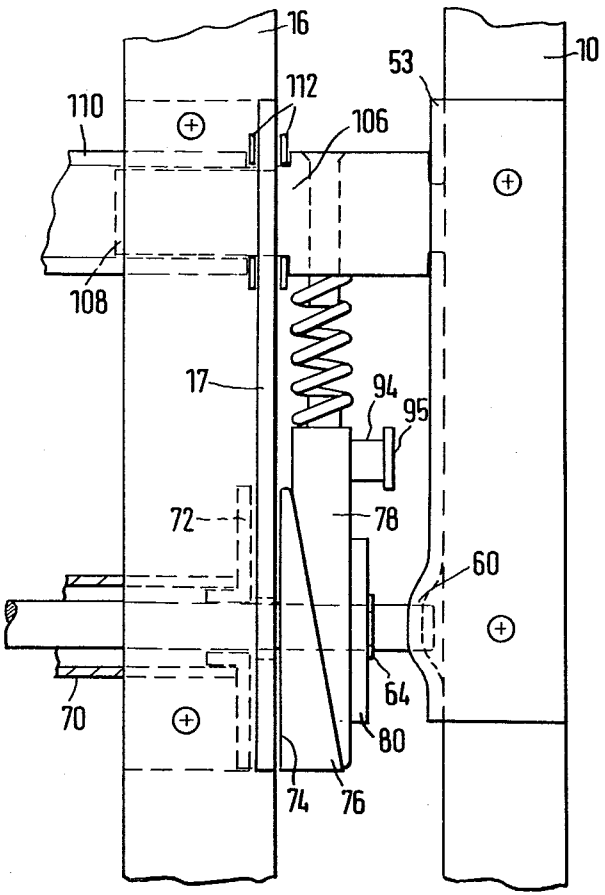
Fig.6
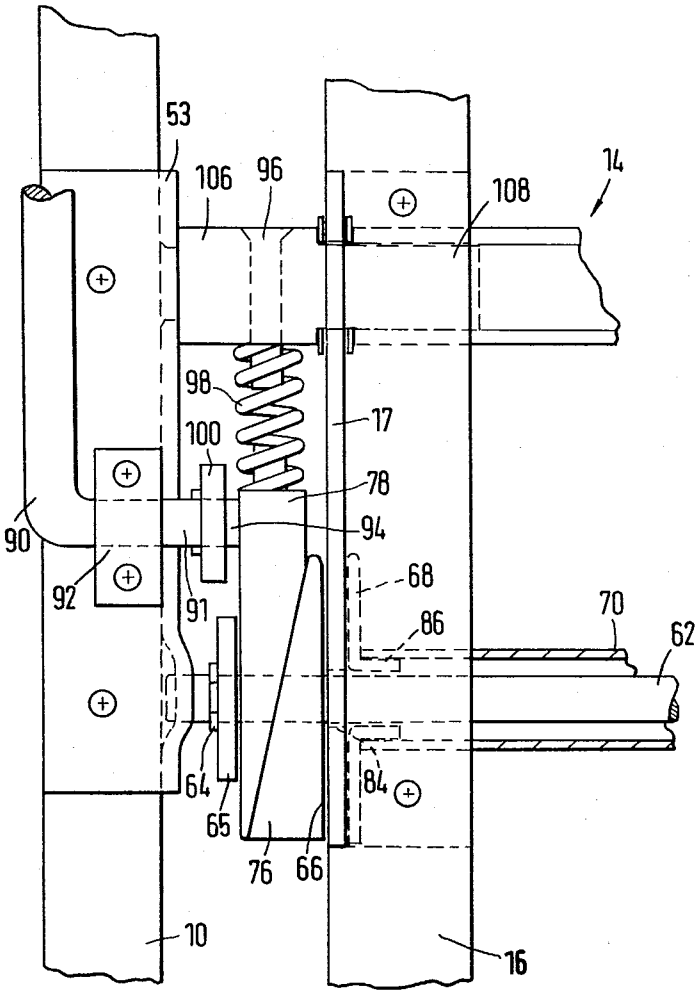

PIECE OF FURNITURE FOR SITTING AND LYING

The invention relates to a piece of furniture for sitting and lying, more particularly a sickbed having a horizontal surface divided into a head portion, a central portion, and a foot portion, and a stationary frame extending at least over the length of the central portion, the head and foot portions being pivotally mounted on the stationary frame about horizontal axes, and which can be adjusted to horizontal and inclined positions by shifting the weight of the user's body and can be fixedly positioned by locking devices.

Prior constructions of the type described above do not all have a satisfactory function, especially when they are to be employed in sickbeds and the patient finds it difficult to make the comparatively large shifts in weight needed for the adjustment.

It is an object of the invention to provide an improved piece of furniture for sitting and lying, wherein the adjustability of the head portion responds more readily to shifts in weight and the adjustability is largely independent of the user's weight.

Another object of the invention is to provide an improved locking device which is distinguished by simple components and by a space-saving design and which, in the case of an adjustable bedstead or an adjustable bedchair, is capable of absorbing the necessary locking forces and transferring them to the frame.

According to the invention, a piece of furniture for sitting and lying of the type indicated above is characterized in that the head portion can rotate about its steering shaft by means of a torsion spring carried on the stationary frame, and that the longitudinal elements of the central portion are carried on supporting elements mounted with allowance for end play on a lower extension of the head portion.

Due to the weight equalization, the head portion—after release of the locking device—rises from its horizontal position to a vertically inclined position by a very slight shift of the user's weight, so that for physically handicapped users the normally arduous task of sitting up is made easier.

Readjustment to the horizontal position is simple. The adjustability of the head portion is facilitated by the fact that it is not necessary to move the whole central portion. Rather, the carrying longitudinal elements of the central portion rest, with allowance for end play, on the supports mounted on the lower extension of the head portion, so that the adjustment of the head portion via the longitudinal elements of the central portion can also be influenced. Since the supporting elements mounted on the extension of the head portion are in a leverage ratio to the steering shaft of the head portion, the angle of inclination can be increased at will by shifting the user's weight to his pelvis located in the bend between head portion and central portion until he sits up completely. The central portion automatically comes to a favorable, slightly backwardly sloping, sitting position.

In the form of horizontal bolts, the supporting elements may be mounted on the lower extension of the head portion substantially in the plane thereof. This results in a simple construction of the head portion and, at the same time, in ease of connection of the central portion during assembly, e.g., during the mass production of a bedstead. The horizontal bolts ensure that the mattress areas resting on the longitudinal elements are on substantially the same level as those of the head portion in its horizontal position.

According to another feature of the invention, the supporting elements may be laterally affixed to the lower extension of the head portion and carried in elongated slots of the longitudinal elements. In this way, the longitudinal elements and the supports move relative to one another in such a way that all slope changes of the head portion are taken in the elongated slots of the longitudinal elements and the central portion, aside from slight slope adjustments, do not execute longitudinal motions.

The torsion spring extending transversely over the width of the head portion, or of a portion thereof, may be fixedly positioned at both ends to prevent it from turning on the stationary frame, and its middle may be fixedly connected to the head portion. Alternatively, the torsion spring may be connected at both ends with the head portion and with the steering shaft secured in the stationary frame to prevent it from turning.

In order to be able to make subsequent adaptations to certain loads or preferred slopes independently of the design of the torsion spring, the latter is adjustably secured so as to control the initial stress applied to the head portion. The torsion spring may consists of a torsion rod which is split in the middle, or of other spring means, e.g., wound spiral springs mounted at one end on the stationary frame and, at the other end, on the head portion.

In accordance with the invention, the locking device is characterized by segments affixed on both sides to the head portion and provided with arcuate guide slots, through which extends a transverse shaft held in the encircling frame, parallel to the steering shaft, further characterized by brake discs containing brake disc pairs which move on the transverse shaft and lie opposite the segments, the sliding path of the pairs of brake discs being limited outwardly and a distance piece being disposed between the two inner brake discs, and further characterized by at least one operating element located on one side of the encircling frame between the latter and the head portion and consisting of two wedge-shaped pieces extending vertically to the transverse shaft and moving relative to one another thereon, one of the wedge-shaped pieces being constructed as an outer brake disc and the other brake disc abutting against a plate which is immobilized in an axial direction on the transverse shaft. Thus, the head portion can be effectively locked in any inclined position, since the operation of both pairs of brake discs occurs automatically and simultaneously. Owing to the latching on both sides of the head portion, the locking forces are distributed, so that the segments and the brake discs remain comparatively small and can be accommodated in a space-saving manner.

The invention will now be described with reference to the preferred embodiments shown in the drawing, wherein:

FIG. 6 is a schematic, partially cut, top view of the head portion within an encircling frame in the area of the locking device.

Figure 1:
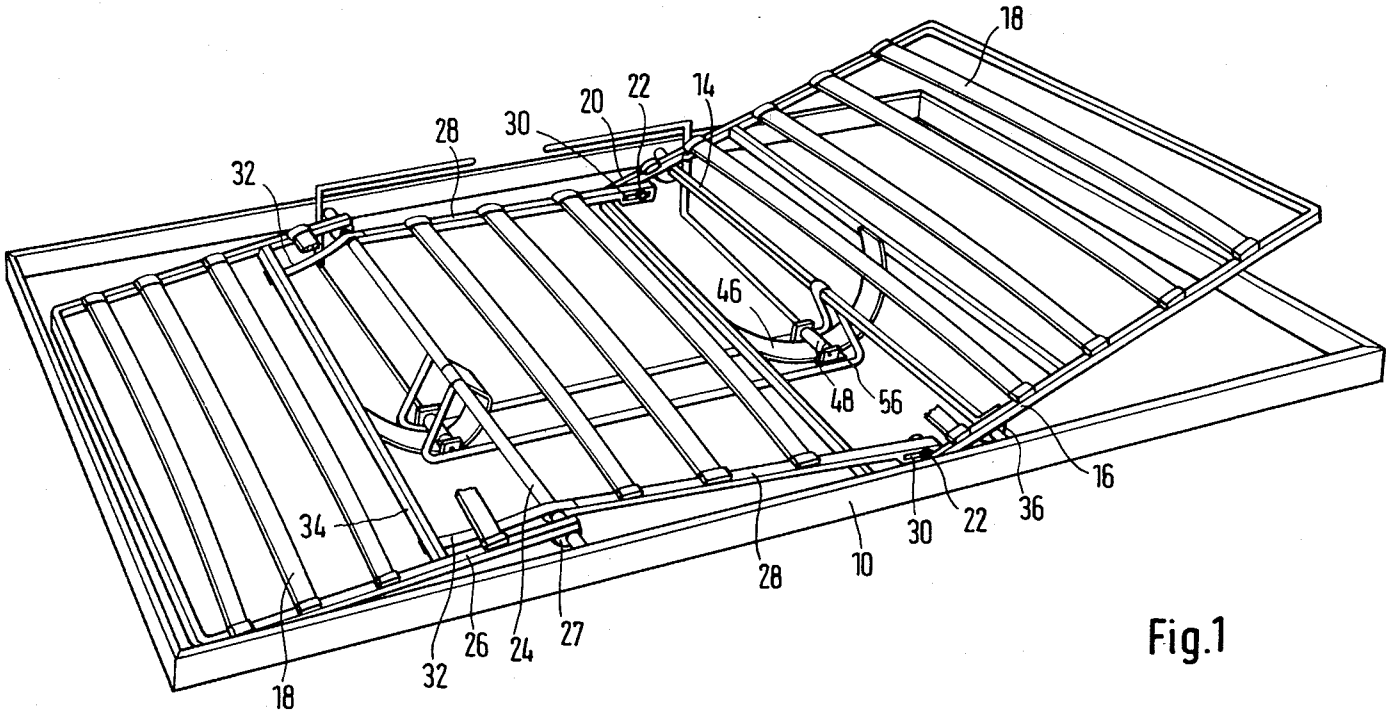
FIG. 1 is a schematic perspective view of a preferred embodiment serving as a bedstead.

The bedstead chosen as a practical example and illustrated in FIG. 1 consists of an encircling frame 10 mounted on a base (not shown) having vertical sides. The frame is stiffened by a transversely extending steering shaft 14, on which is pivotally mounted a head portion 16 consisting of a frame and cross rails 18 affixed thereto and having an extension 20 beyond the steering shaft 14, to which supporting elements, e.g., bolts 22, are affixed.

Figure 2:
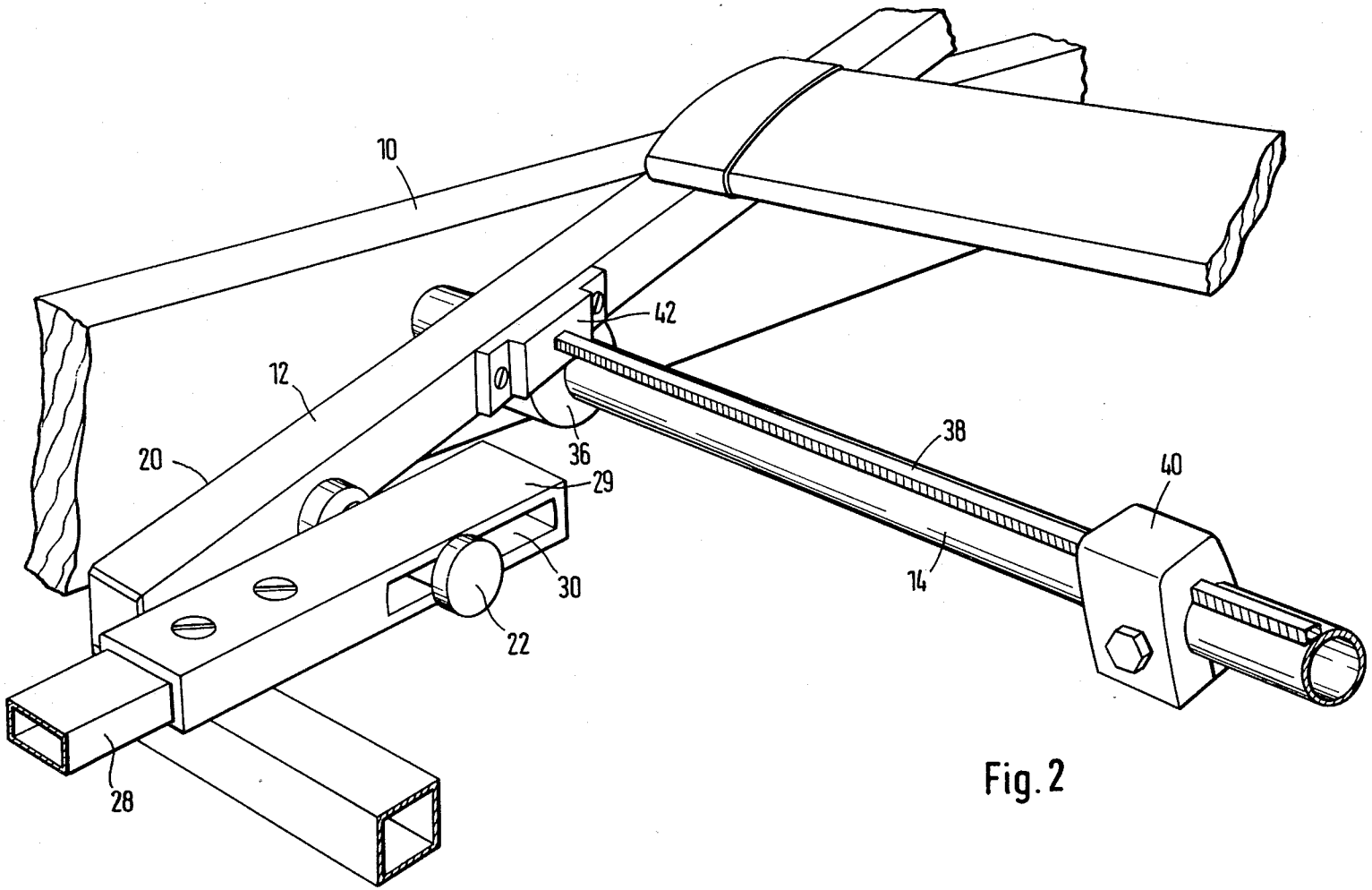
FIG. 2 is an enlarged perspective view of a detail of the connection between central and head portions.

Between the sides of the enclosing frame 10 there extends a second transverse shaft 24, on which is pivotally mounted a foot portion 26. Here, too, cross rails 18, consisting, say, of resilient wood and carried in conventional rubber bearings, serve as a mattress support. The central portion completing the bedstead or the piece of furniture for sitting and lying, as the case may be, is essentially formed by two carrying longitudinal elements 28, between which run cross rails 18. At their mounting ends pointing to the head portion 16, the longitudinal elements 28 are provided with end segments 29 containing elongated slots 30 (FIG. 2). The bolt-shaped supporting elements 22 affixed to the side legs of the extension 20 of head portion 16 extend through the elongated slots 30.

Figure 3:
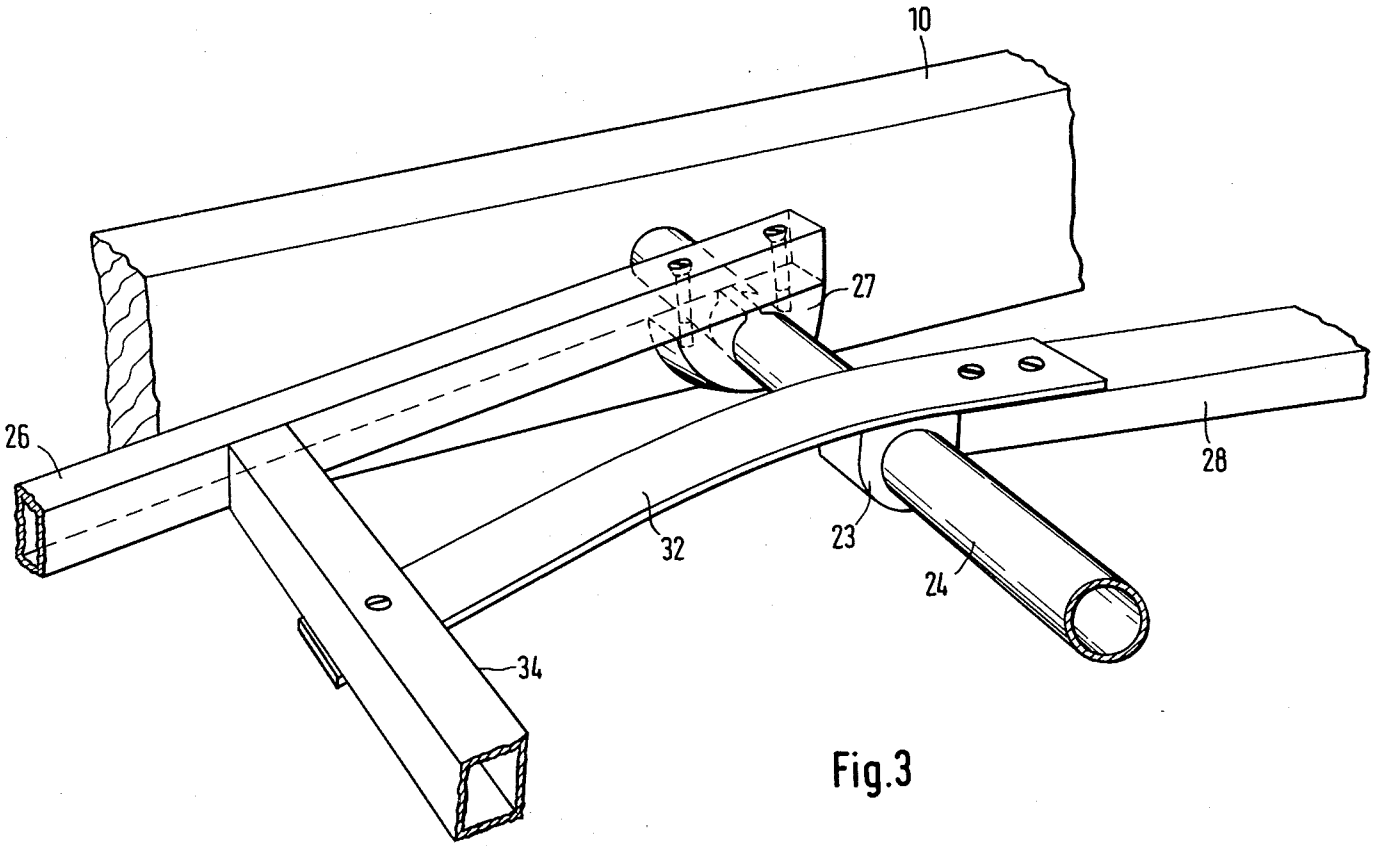
FIG. 3 is an enlarged detail of the connection area between central and foot portions.

As apparent from FIGS. 1 and 3, the opposite ends of the longitudinal elements of the central portion are connected with bearing elements 23 to the transverse shaft 24, on which is pivotally mounted the foot portion 26 with bearing shells 27. The longitudinal elements 28 are lengthened by flat-spring segments 32 extending across the transverse shaft 24 and secured below a crosstie 34 of the foot portion. The spring segments 32 take the load off the foot portion and strive to hold the foot portion in a raised position, i.e., all the more so as the central portion slopes downwardly at the other end. The pivotal mounting of the foot portion is not obligatory within the framework of the invention. The foot portion could also be retained in a slightly horizontal position.

During the slope changes of the head portion 16, the supporting elements 22 slide in the elongated slots 30 of the longitudinal elements 28. FIG. 2 shows that by shifting the weight, the central portion acts with the lever arm upon the extension 20 of the head portion, depending upon the distance between the supporting elements 22 and the steering shaft 14 and, therefore, it can also be used in conjunction with the existing counterweight to adjust the slope of the head portion by means of the spring elements acting upon the steering shaft 14. The flexible and longitudinally extensible connection of the longitudinal elements 28 to the extension 20 of the head portion assures a rearwardly directed downward slope of the central portion, which results in an advantageous sitting position when the head portion is inclined upwards.

The head portion 16 is rotatably mounted on the tubular transverse shaft 14 with bearing shells 36 connected to its bottom side. A torsion spring 38 in the form of a torsion rod with a connection element 40 in its middle is held in position on the transverse shaft 14, while the rod ends are laterally affixed to the head portion frame by means of retaining devices 42.

Separate locking devices are provided to immobilze the head and foot portions in their adjusted slopes. As can be seen in FIG. 1, the locking device for the head portion 16 consists of a bent piece 46 concentric to the steering shaft 14, its ends being affixed to crossties of the head portion. The bent piece 46 serves as a braking surface, against which abuts a plastic eccentric disc 48. The eccentric disc rests on a brake shaft which can be rotated with a hand lever. The brake shaft is mounted in buttstraps of an auxiliary frame 56.

Figure 4:
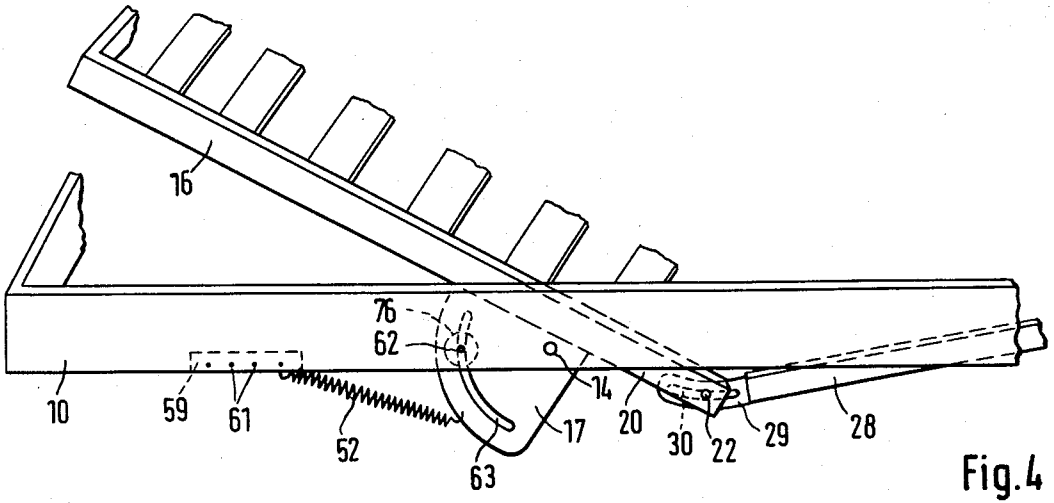
FIG. 4 is a broken-away side view of a bedstead embodying the principles of the invention.
Figure 5:
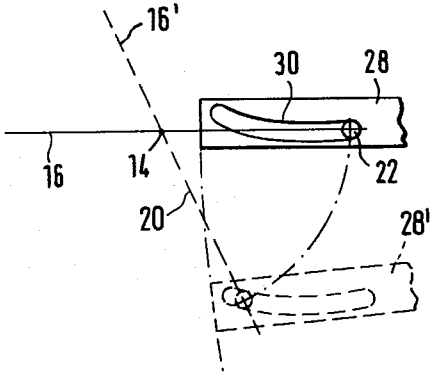
FIG. 5 is a layout for the purpose of explaining the relationship between the connection bolts of the head portion and an arcuate guide slot of the central portion.

In the embodiment of FIGS. 4 and 5, the slots 30 in the longitudinal elements 28 extend substantially in the same direction as the longitudinal elements and curve slightly upwards towards the head portion. The slots carry horizontal bolts 22 secured in extension 20 of the head portion and, if necessary, provided with rolls carried in the slots. As can be seen in FIG. 5, when the head portion is semi-inclined or more steeply inclined, the bolts 22 are moved more easily and forwardly by shifting the user's body than if the slots 30 extended rectilinearly downwards in continuation of the downwardly sloping central portion. When the head portion is raised, the bolts or rolls have to overcome a lesser resistance in the elongated slots 30, so that with decreasing elastic force and further change in the slope of the head portion, inhibitory frictional forces can no longer exert an influence and the shift in the user's weight will produce a greater effect.

As shown in FIG. 4, there are affixed laterally or to the lower side of the head portion 16 sheet-metal segments 17 which extend in vertical planes and contain an arcuate guide slot 63 running around the steering shaft 14. Through the guide slot 63 there extends a transverse shaft 62 which is fixedly mounted in the encircling frame 10 and on which a locking device in the form of brake discs 76 moves transversely in order to hold in the adjusted slope the segments 17 and, thereby, the head portion 16.

In order to compensate the weight of the head portion 16, or to bias the head portion into an inclined position, tension springs 52 are suspended on both sides of the encircling frame 10, and are suspended with their other end in an opening on the border of the segments 17. On the encircling frame, the tension springs are suspended in bolts or hooks 61 which originate in a fitting 59 affixed to the encircling frame.

Figure 7:
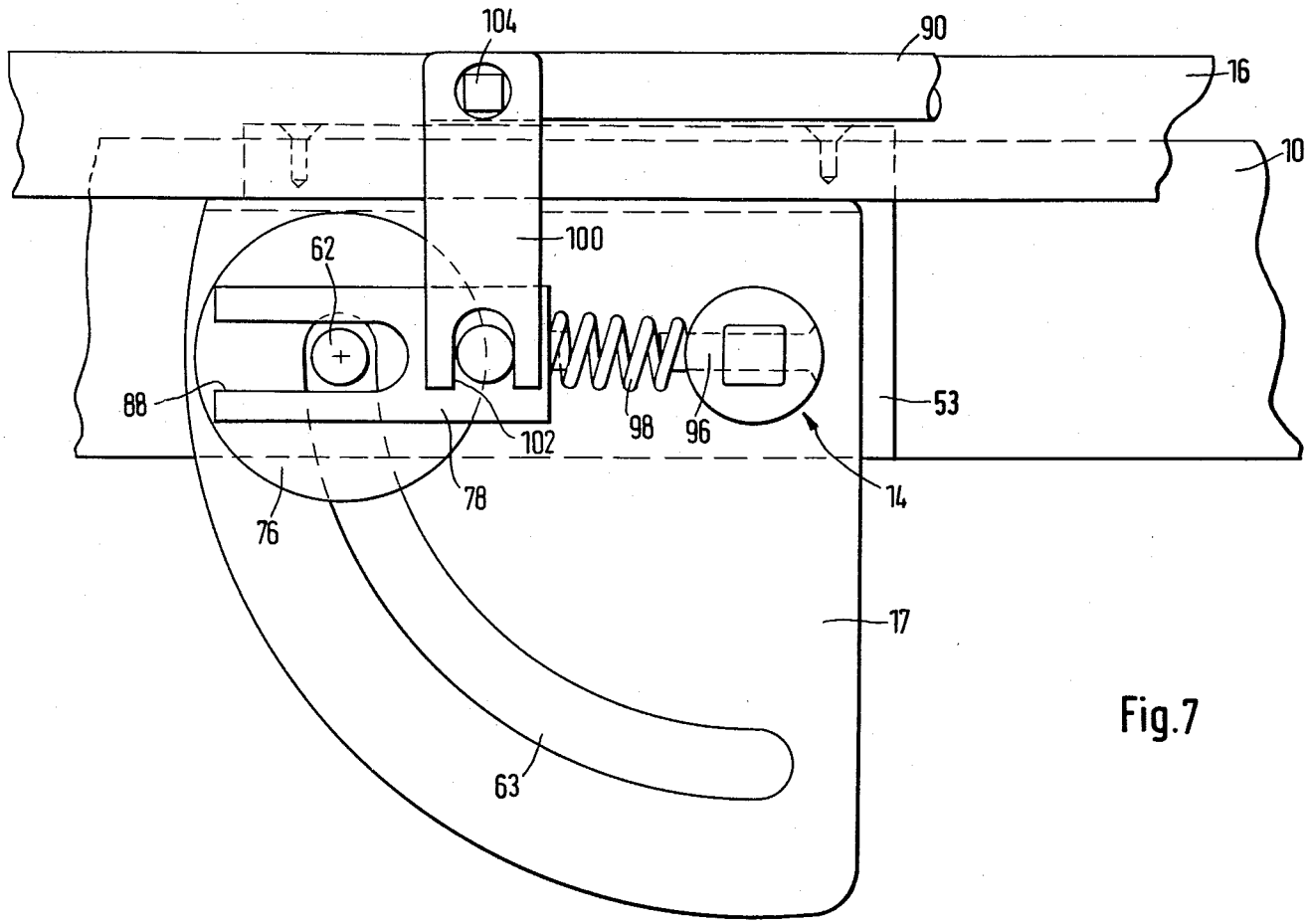
FIG. 7 is a schematic view of the locking device shown in FIG. 6.

As shown in FIGS. 6 and 7, segments 17, which point vertically downwards and substantially correspond to a quarter arc and which may be pushed up with one opening into the steering shaft 14 of the head portion 16, originate in the lower side of the head portion 16. The steering shaft 14 is carried on the sides of the encircling frame 10 of a bedstead on fittings 53 affixed thereto. The fittings 53 contain location holes 60 for holding a steering shaft 62 that extends through the arcuate slots 63 of segments 17. As can be seen from FIG. 6, from left to right, there are mounted on the transverse shaft 62 a delimitation element 64 (cotter pin or snap ring), an end disc 65, an outer wedge-shaped piece 78 pushed up with one elongated slot onto the transverse shaft 62, an inner wedge-shaped piece 76 pushed up with one hole onto the transverse shaft and acting with its surface 66 opposite the segment 17 as an outer brake disc, an inner brake disc 68, a distance tube 70, brake discs 72 and 74 associated with a second pair of brake discs, with the brake disc 74 forming at the same time the inner wedge-shaped piece 76, an outer wedge-shaped piece 78, a holding disc 80, as well as a delimitation element 64.

In the embodiment shown, the inner brake discs 68 and 72 consist of simple sheet-metal sections with an integrally cast collar 86, with which they are mounted on the transverse shaft 62 with allowance for sliding. The distance tube 70 is slided over the collar 86 of the two brake discs 68 and 72.

There abut against the wedge surface of the (e.g., circularly designed inner wedge-shaped pieces 76 the outer wedge-shaped pieces 78 which, as apparent from FIG. 7, are pushed up with one elongated slot 88 onto the transverse shaft 62 and are carried thereon. In addition, the outer wedge-shaped pieces 78 are carried on bolts 96 originating in the steering shaft 14 and continually biased in the clamping direction by sufficiently strongly designed pressure springs 98, so that the locking device is normally operated. The springs 98 surround the bolts 96 and are carried on the steering shaft 14.

The operating elements provided on both sides of the head portion 16 are capable of transmitting sufficiently high braking forces to the segments 17 affixed to the head portion. Owing to the sets of wedges on both sides, not only a reliable locking of the head portion is obtained, but also the additional stiffening thereof in the clamped state. The construction shown offers the possibility of providing an operating lever 90 either on the left or right side of the enclosing frame 10.

As shown in FIG. 6, there is provided on the left side of the encircling frame on the top side thereof an operating lever 90 which carries at its end 91 a downwardly bent leg 100. The leg 100 is moved with a downwardly pointing elongated slot 102 via a pin 94 having an extra wide end 95 and protruding laterally from the wedge-shaped piece 78. As apparent from FIG. 7, the angular leg 100 is positively locked and removably mounted on a square 104 of the operating lever 90. To mount the operating lever 90 in the manner shown in FIG. 6 on the right side of the encircling frame, only the leg 100 need be taken off and, after a 180° rotation, pushed up again onto the square 104.

If the user wishes to swivel the head portion 16, he raises the operating lever 90 from the horizontal position shown in FIG. 7, thereby causing the other wedge-shaped piece 78, which moves away from the wedge-shaped piece 76 against the tension of the spring 98, to be carried via the leg 100. The wedge-shaped piece 78 mounted on the other side and acted upon by the tension of its spring cannot by itself, maintain the braking, since the inner end of the elongated slot 88 already abuts against the steering shaft 62. The segments 17 affixed to the head portion can now move between the pairs of brake discs. The operating lever 90 is released to perform its locking function, with the result that it returns to the horizontal position when, due to the tension of spring 98, the wedge-shaped piece 78 acts upon the wedge-shaped piece 76 so as to move the braking surface 66 to the right, as shown in FIG. 6. By simultaneously causing the wedge-shaped piece to abut against the holding disc 65, the steering shaft 62 is moved to the left in the openings 60, so that the holding plate 65 located at the other end urges the wedge-shaped piece 76 with its braking surface 74 against the right segment 17. The two outer braking surfaces 66 and 74 continue to approach one another until the inner brake discs 68 and 72 abut against the segments and a motion and force equalization occurs over the distance tube 70. Due to the intrinsic elasticity of the distance tube, following interlock, restoring forces become effective which automatically maintain the locking.

As shown in FIG. 6, the steering shaft 14 consists of two fixedly connected axle journals 106 affixed to the encircling frame 10. In the axle journals, the bolts 96 are mounted to carry the outer wedge-shaped pieces 78. The axle journals 106 extend into tapered pin sections 10 having a square or similar shape. The segments 17 are pushed up onto the pin 108. Holding discs 100 may be disposed on both sides of the segments. The pin sections 108 are connected together by means of a distance tube 112.

I claim:

1. An article of furniture for sitting or lying comprising a surface adapted to support the body of a user, said surface having head, central and foot portions, a stationary frame extending over at least the length of said central portion, said head portion being pivotally mounted to said frame about a horizontal steering shaft and adjustable between horizontal and inclined positions by shifting the weight of the user's body, means for locking said head portion in a selected position, said head portion having extension portions extending toward said foot portion beyond said steering shaft, spring means operative about said steering shaft for equalizing the weight of said head portion, said central portion having longitudinal side members supported by supporting elements comprising pin and slot connections with said extension portions of said head portion, the slots of said pin and slot connections being upwardly curved.

2. A piece of furniture according to claim 1, wherein the supporting elements are mounted as horizontal bolts on the lower extension of the head portion substantially in the plane of the head portion.

3. A piece of furniture according to claim 2, wherein the supporting elements are laterally affixed to the lower extension of the head portion and are carried in elongated slots of the longitudinal elements.

4. A piece of furniture according to claim 2, wherein said spring means extends over the width of the head portion and is immobilized at both ends to prevent it from turning on the stationary frame, the middle of the spring means being fixedly connected with the head portion.

5. A piece of furniture according to claim 4, wherein said spring means comprises a torsion spring connection at both ends with the head portion and with the steering shaft secured in the stationary frame.

6. A piece of furniture according to claim 5, wherein the torsion spring is adjustably mounted with respect to its initial stress acting upon the head portion.

7. A piece of furniture according to claim 1, wherein the longitudinal elements of the central portion are rotatably mounted on a transverse shaft secured in the frame and also carrying the foot portion (26).

8. A piece of furniture according to claim 6, wherein the longitudinal elements are lengthened by flat springs 32 which bear against the transverse shaft of the foot portion and are affixed, with an area extending into the foot portion, to the lower side of a cross tie (34) of the foot portion.

9. A piece of furniture according to claim 1, wherein the stationary frame comprises an encircling frame mounted on a subframe and embracing the head, the central, and the foot portions in horizontal position.

10. A piece of furniture according to claim 1, characterized in that the spring means for the weight equalization of the head portion consists of two tension springs held with one end on the side of the frame, the other ends being connected with necks (17) projecting laterally from the head portion downwards above the steering shaft thereof and including, fittings on the frame with spaced-apart projections for suspending the spring ends and for adjusting the spring tension (FIG. 4).

11. A piece of furniture according to claim 10, characterized in that the necks on the lower side of the head portion are sheet-metal segments (17) extending in vertical planes and containing a slot running arcuately around the steering shaft of the head portion, a transverse shaft (62) supported on the frame and carrying a locking device being guided in said slot.

12. A piece of furniture according to claim 1, wherein the rear section of the slots is upwardly inclined so that the pins (22), in the case of a comparatively steeply inclined head portion, receive from the upper sides of the guide-slots a component of force directed rearwardly to the slot end.

13. A piece of furniture according to claim 1, characterized by segments (17) mounted on both sides of the head portion and having arcuate guide slots, through which extends a transverse shaft (62) carried in the encircling frame, further characterized by pairs of brake discs accommodating the segments therebetween and sliding on the transverse shaft and whose sliding path is delimited outwardly, a distance piece (70) being disposed between the two inner brake discs, and further characterized by at least one operating mechanism mounted on one side of the frame between the latter and the head portion and consisting of two wedge-shaped pieces extending vertically to the transverse shaft and moving relative to one another thereon, one of the wedge-shaped pieces being designed as an outer brake disc and the other brake disc abutting against a plate (80) immobilized on the transverse shaft.

14. A piece of furniture according to claim 13, wherein the transverse shaft (62) is carried in fittings (64) secured in openings (60) on both sides of the frame, with allowance for sliding.

15. A piece of furniture according to claim 14, characterized in that the steering shaft (14) of the head portion and the transverse shaft (62) are carried in the same fittings (64) on the encircling frame.

16. A piece of furniture according to claim 13, wherein both brake discs have an outwardly directed wedge surface and form the operating mechanism with the associated wedge-shaped piece (78) sliding vertically to the transverse shaft.

17. A piece of furniture according to claim 13, wherein the wedge-shaped pieces (76) operating as outer brake discs are pushed up with one hole, and the outer wedge-shaped pieces (78) are pushed up with one elongated slot, onto the transverse shaft (62), one of the outer wedge-shaped pieces capable of being displaced longitudinally by means of an operating lever (90) mounted on the encircling frame (10).

18. A piece of furniture according to claim 17, wherein the outer wedge-shaped pieces are carried on bolts (96) affixed to the transverse shaft and are biased into a brake-actuating position by means of springs (98) surrounding the bolts.

19. A piece of furniture according to claim 18, wherein the outer wedge-shaped pieces carry a laterally protruding pin (94) which is overlapped by an angular leg (100) of the operating lever with a downwardly pointing elongated slot (102).

20. A piece of furniture according to claim 19, wherein the operating lever is mounted either on the right or on the left side of the encircling frame and the angular leg (100) is positively locked and removably mounted by means of a square.

21. A piece of furniture according to claim 13, wherein the steering shaft (14) of the head portion consists of two axle journals (106) in which are mounted the guide bolts (96) for the wedge-shaped pieces, the axle journals having a tapered square-head pin (108) and being connected together by a distance tube pressed thereon.

* * * * *